US009328481B2

(12) United States Patent
McKee et al.

(10) Patent No.: US 9,328,481 B2
(45) Date of Patent: May 3, 2016

(54) METHOD OF OPERATING A MATERIAL HANDLING MACHINE

(71) Applicant: JC Bamford Excavators Limited, Uttoxeter (GB)

(72) Inventors: Michael McKee, Uttoxeter (GB); Matt Cook, Uttoxeter (GB)

(73) Assignee: JC Bamford Excavators Limited, Uttoxeter (GB)

( * ) Notice: Subject to any disclaimer, the term of this patent is extended or adjusted under 35 U.S.C. 154(b) by 0 days.

(21) Appl. No.: 14/595,017

(22) Filed: Jan. 12, 2015

(65) Prior Publication Data

US 2015/0197920 A1 Jul. 16, 2015

(30) Foreign Application Priority Data

Jan. 13, 2014 (GB) ..... 1400479.0

(51) Int. Cl.

| | |
|---|---|
| ***G06F 7/70*** | (2006.01) |
| ***E02F 9/22*** | (2006.01) |
| ***E02F 9/08*** | (2006.01) |
| ***E02F 9/20*** | (2006.01) |

(52) U.S. Cl.

CPC ..... *E02F 9/2246* (2013.01); *E02F 9/085* (2013.01); *E02F 9/2066* (2013.01)

(58) Field of Classification Search

None

See application file for complete search history.

(56) References Cited

U.S. PATENT DOCUMENTS

| | | | | |
|---|---|---|---|---|
| 4,373,850 | A | 2/1983 | Durham | |
| 6,694,240 | B1 | 2/2004 | Swick et al. | |
| 2008/0127531 | A1 * | 6/2008 | Stanek et al. | 37/443 |
| 2008/0133094 | A1 * | 6/2008 | Stanek et al. | 701/50 |
| 2008/0254939 | A1 | 10/2008 | Ichimura | |
| 2013/0074377 | A1 | 3/2013 | Colbert | |
| 2013/0333664 | A1 * | 12/2013 | Killion et al. | 123/339.16 |

FOREIGN PATENT DOCUMENTS

| | | | |
|---|---|---|---|
| EP | 1 526 221 | A1 | 4/2005 |
| JP | 2003/120358 | A | 4/2003 |
| WO | WO-2008/066649 | A1 | 6/2008 |

OTHER PUBLICATIONS

Search Report for GB 1400479.0, dated Jun. 25, 2014.

Extended European Search Report for EP 14 19 8108, dated Jun. 10, 2015.

* cited by examiner

*Primary Examiner* — Adam Alharbi

(74) *Attorney, Agent, or Firm* — Marshall, Gerstein & Borun LLP

(57) ABSTRACT

A method of operating a material handling machine, the machine including an engine, ground engaging means, and a control means selectively operable by an operator to move the ground engaging means, the method including the steps of:

a) starting with the ground engaging means in a first position and the engine running at a first engine speed, b) actuating the control means to move the ground engaging means towards a second position, actuation of the control means causing the engine speed to increase, c) unactuating the control means so as to simultaneously stop movement of the ground engaging means and allow the engine speed to reduce towards the first engine speed.

22 Claims, 2 Drawing Sheets

METHOD OF OPERATING A MATERIAL HANDLING MACHINE

BACKGROUND OF THE INVENTION

The present invention relates to a method of operating a materials handling machine.

Known materials handling machines such as back hoe loaders or mini excavators can perform material handling operations whilst stationary. Thus, the back hoe of a back hoe loader can be used to move material whilst the back hoe loader is stationary. Similarly, the working arm of a mini excavator can be used to move material while the excavator is stationary.

Such machines include stabilisers or the like which can be moved into engagement with the ground to help stabilise the machine whilst performing material handling operations. In one example the back hoe loader has a stabiliser on each side of the back of the machine. Each stabiliser can be individually lowered into contact with the ground. It is often advantageous to lower the stabilisers into engagement with the ground such that the rear wheels of the back hoe loader are lifted from the ground. This provides for a more stable arrangement since the elastomeric tyres of the back hoe loader then do not carry any of the weight of the back hoe loader.

Similarly, known excavators have a blade at the front of the machine running transversely. This blade can be lowered into engagement with the ground to help stabilise the machine.

The stabilisers are lowered into engagement with the ground by operating hydraulic rams or the like.

When setting up to dig a trench or the like when the vehicle is stationary, one of the first operations performed by the operator is to move the stabilisers into engagement with the ground. In order to save time, the operator will typically fully actuate the control lever or levers that deploy the stabiliser or stabilisers. This can put a high demand on the hydraulic pump which supplies hydraulic oil to the rams or the like which move the stabilisers. This in turn puts a high demand on the engine that drives hydraulic pump. Because deployment of the stabilisers is one of the first operations performed, the operator may be running the engine at an idle speed. Certain scenarios may cause the engine to lug down (i.e. slow down significantly below a normal idle speed) or even stall. Thus, consider the scenario where the machine has been left unused overnight in a cold climate. The operator, starting work for the day will enter the cab, start the engine, and almost immediately then deploy the stabilisers. Because the engine has not properly had time to warm up, and because the hydraulic oil is cold, the full deployment of the stabilisers causes a high load to be applied to the engine, which as mentioned above, may be running at an idle speed. This high load may be sufficient for the engine to "lug" down, i.e. slow down significantly below a normal idle speed, or may even cause the engine to stall. Clearly this is inconvenient for the operator since it causes delays.

SUMMARY OF THE INVENTION

An object of the present invention is to provide an improved material handling machine.

Thus according to the present invention there is provided a method of operating a material handling machine, the machine including an engine, one or more stabilisers, and a control means selectively operable by an operator to move the one or more stabilisers, the method including the steps of:

a) starting with the one or more stabilisers in a first position and the engine running at a first engine speed, b) actuating the control means to move at least one if the stabilisers towards a second position, actuation of the control means causing the engine speed to increase, c) unactuating the control means so as to simultaneously stop movement of said at least one of the stabilisers and allow the engine speed to reduce towards the first engine speed.

Advantageously as the or each stabiliser is moved then the engine speed is automatically increased without the need of operator input. Once the or each stabiliser has been moved to an appropriate position (e.g. either deployed or retracted) then the engine speed will reduce, thereby saving fuel.

The first engine speed may be an engine idle speed.

The machine may include one or more operator actuated throttles, the or each operator actuated throttle may be set to one of an engine idle speed or a disabled condition.

The first engine speed may be above an engine idle speed and may be set by an operator actuator throttle device.

The machine may include an auto idle function operable to reduce the engine speed below an engine speed defined by the operator actuated throttle device after a period of inactivity.

The method may include the step of:—d) allowing the auto idle function to reduce the engine speed to below the first engine speed.

The one or more operator actuator device may be selected from a hand throttle and a foot throttle.

The or each stabiliser may be constrained to move through a predetermined path when moving between the first position and the second position.

The one or more stabilisers may be defined by a first stabiliser mounted on a right hand side of the machine and a second stabiliser mounted on a left hand side of the machine.

The first and second stabilisers may be mounted on the rear of the machine.

The first and second stabilisers may be mounted on the front of the machine.

The first and second stabilisers may be pivotally mounted about a generally horizontal axis to move between a retracted and deployed position.

The first and second stabilisers may be translatable generally vertically to move between a retracted and a deployed position.

The one or more stabilisers may be defined by a transversely orientated blade.

The blade may be pivotally mounted about a generally horizontal axis.

The blade may be pivotally mounted directly to a chassis of the machine so as to be constrained to move about an arc.

A first link may be pivotally mounted directly to a chassis of the machine and may be pivotally mounted to the blade and a second link may be pivotally mounted directly to the chassis of the machine and may be pivotally mounted to the blade so as to form a four bar linkage.

The machine may further include one or more elastomeric ground engaging motive devices.

During step b), the engine speed may increase to a predetermined speed.

During step b) engine speed may increase proportionally to an amount of actuation of the control means.

During step b) only actuation of the control means beyond a predetermined position may cause the engine speed to increase.

BRIEF DESCRIPTION OF THE DRAWINGS

The invention will now be described, by way of example only, with reference to the accompanying drawings in which.

DETAILED DESCRIPTION

Figure 1:
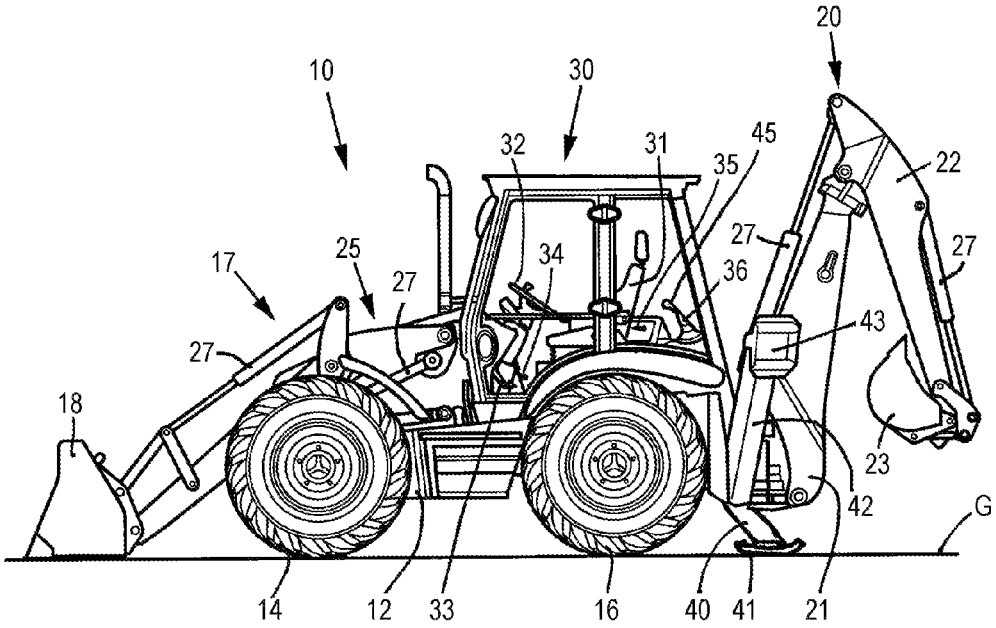
FIG. 1 shows a back hoe loader which can be operated according to the present invention.

With reference to FIG. 1 there is shown a materials handling vehicle in the form of a back hoe loader 10 having a chassis 12 supported by front wheels 14 and rear wheels 16. Mounted on the chassis is a loading arm 17 at the front of which is mounted an implement, in this case a loading shovel 18. The loading arm and loading shovel are mounted on the front of the vehicle. The loading shovel can pivot relative to the loading arm and the loading arm can pivot relative to a chassis of the vehicle. Accordingly, the loading shovel may be moved to a desired position, and in particular the loading shovel is not constrained to move through a predetermined path when moving between a first position and a second position.

Mounted on the back of the vehicle is a back hoe 20 having a boom 21, a dipper arm 22 and a bucket 23. The bucket can pivot relative to the dipper arm and the dipper arm can pivot relative to the boom and the boom can pivot relative to a chassis of the vehicle. Accordingly, the bucket can be moved to any desired position, in particular the bucket is not constrained to move through a predetermined path when moving between a first position and a second position.

The vehicle includes an engine 25 which provides power to drive the vehicle over the ground via the wheels. The engine 25 also provides power to operate a hydraulic pump which can selectively provide pressurised hydraulic fluid to the various rams 27 of the vehicle to operate the loading arm, loading shovel, boom, dipper, bucket etc so as to enable material to be handled. The vehicle includes an operator cab 30 including an operator seat 31. The operator cab includes operator control such as a steering wheel 32, foot brake 33, foot throttle 34, hand throttle 35, and back hoe control lever 36.

As shown in FIG. 1 the operator seat 31 is facing forwards. The operator seat is rotatable and can be rotated so as to face the rear of the vehicle. When facing the rear of the vehicle, the hand throttle 35 and back hoe control lever 36 are readily accessible by the operator.

The back hoe loader 10 also includes a rear right stabiliser 40 having a ground engaging foot 41 and a rear left stabiliser 42 with a ground engaging foot 43. As shown in FIG. 1 the rear right stabiliser 40 has been deployed such that the foot 41 is in engagement with the ground G and the rear left stabiliser 42 is in a fully retracted position such that the ground engaging foot 43 is not in engagement with the ground G and is remote from the ground G. Each stabiliser can be independently moved between a retracted position and a deployed position via a control device 45 which, in this case, is mounted on the back hoe control lever 36.

As mentioned above, FIG. 1 shows the right rear stabiliser in the deployed position and the rear left stabiliser in a retracted position. This is an unusual position for the stabilisers to be in (normally they would both be fully retracted or both be fully deployed) but nevertheless they are shown in this position to assist in the explanation of the present invention. Each stabiliser can pivot between a retracted and deployed position via a generally horizontal pivot axis. Each stabiliser is moved between a retracted and deployed position by operation of a hydraulic ram (not shown) selectively supplied by pressurised hydraulic fluid from the hydraulic pump which is driven by the engine 25. As will be appreciated, that part of the stabiliser that engages the ground (i.e. the foot 41 or 43) is constrained to move through a predetermined path, in this case an arc having a centre at the pivot about which a particular stabiliser rotates when moving between the deployed and retracted positions.

Examples of operation of the present invention are as follows: Example 1 The vehicle is driven to a site and parked ready for working the following day. The shovel 18 has been lowered into engagement with the ground and the rear right and rear left stabilisers are in their retracted position such that the ground engaging feet 41 and 43 are remote from the ground.

The next day the operator enters the cab and starts the engine. The engine will be running at an idle speed, in this example 800 rpm. The operator then turns the seat 31 to face rearwardly and operates the control device 45 so as to move the rear right stabiliser 40 and rear left stabiliser 42 into their deployed positions such that the ground engaging foot 41 and ground engaging foot 43 engage the ground. The control device 45 operates to both deploy the stabilisers and also to increase the engine speed to a working speed, in this example 1200 rpm. This increase in speed of the engine provides more power to drive the hydraulic pump which in turn can produce more flow to the hydraulic rams which move the stabilisers 40 and 42. In this manner, not only are the stabilisers moved into engagement more quickly than if the engine was running at an idle speed, the increase in engine speed will prevent lug down and/or stalling of the engine.

Once the stabilisers 40 and 42 have been deployed to the desired position (typically such that the rear wheels 16 are just clear of the ground) the operator will release (or unactuate) the control device 45 whereupon simultaneously the stabiliser or stabilisers will stop moving and the engine speed will be allowed to return back to an idle speed.

Significantly, during deployment of the stabilisers the operator does not need to operate any throttle. In particular, the increase in engine speed from 800 rpm to 1200 rpm is done automatically and similarly the decrease in engine speed from 1200 rpm back to 800 rpm is done automatically thereby saving fuel.

Example 2 At the end of a working day wherein the operator has been digging a trench with a back hoe loader using the back hoe, the operator parks the vehicle with the stabilisers 40 and 42 in a deployed position.

At the next working day, the operator enters the cab and starts the engine which then runs at an idle speed. The operator wishes to continue digging the trench but now needs to move the vehicle forwards, perhaps the length of the vehicle so as to continue digging the trench. In order to do this the operator therefore turns the seat to face rearwardly and operates the control device 45 to move both stabilisers 40 and 42 from the deployed position to the retracted position. Control device 45 causes the engine speed to increase from idle to 1200 rpm which results in the rear stabilisers moving more quickly to the retracted position and also prevents lug down or stall of the engine. Once the stabilisers have reached their retracted position, the operator releases the control device 45 where upon the engine revs fall to an idle speed. The operator then turns the seat to face forwards, lifts the loading arm 17 such that the loading shovel 18 is clear of the ground. If necessary the operator can use the foot throttle 34. The operator then puts the vehicle in gear, drives it forwards using the foot throttle, perhaps the length of the vehicle, and then puts the vehicle into neutral, lowers the loading arm 17 such that the loading shovel 18 is in engagement with the ground, turns the seat to face rearwardly and then deploys the stabilisers 40 and 42 by using the control device. As the stabilisers 40 and 42 are deployed the engine speed will increase from idle to 1200 rpm, thereby lowering the stabiliser more quickly and preventing engine lug down and/or stalling. As will be appreciated, in this second example the above steps can all be performed within a relatively short space of time (perhaps a few minutes) and clearly within this space of time the engine will not have warmed up properly and the hydraulic oil will still be relatively cold.

The back hoe loader 10 may include an auto idle function. Auto idle functions are known and are used in conjunction with a hand throttle. The hand throttle allows an operator to selectively set the engine speed to a working speed above the engine's normal idle speed. Thus, typically, when the operator has turned the seat to face rearwardly and is using the back hoe control lever 36 to manipulate the back hoe to move material and the like, the operator can set the engine speed using the hand throttle 35. In one example, the operator may set the engine speed at a working speed of 2,000 rpm. This ensures that manipulation of the back hoe can be done quickly since a ready supply of hydraulic fluid is available from the hydraulic pump to operate the rams 27 associated with the back hoe. However, should there be a period of inactivity of use of the back hoe, for example should the back hoe not be used for a minute, then the auto idle function operates to automatically reduce the engine speed so as to save fuel. In one example the auto idle function might reduce the engine speed from the working speed of 2,000 rpm down to an idle speed of 800 rpm in one step. When the operator decides to recommence using the back hoe the operator will manipulate the back hoe control lever 36 and the act of manipulating control lever 36 causes a control system to return the engine speed to the working speed of 2,000 rpm.

In further examples, an auto idle function may progressively reduce the engine speed towards an idle speed. However, all auto idle functions operate such that upon recognition of recommencement of work (for example by manipulation of the control lever 36), the engine speed returns to the working speed as defined by the setting of the hand throttle 35.

Thus, an auto idle function operates so as to reduce the engine speed below a hand throttle setting after a period of inactivity and then to increase the speed back to the hand throttle setting upon recommencement of work. This can be contrasted with the present invention which increases the engine speed during movement of stabilisers and the like but which simultaneously ceases movement of the stabilisers and the like and allows the engine speed to fall to either an idle level or to a level set by a hand throttle.

Thus, if the foot throttle has not been pressed and the hand throttle is set to an idle level, then the present invention will increase the engine speed whilst the stabilisers are being moved and when movement of the stabilisers ceases the engine speed will simultaneously start to fall to idle speed. However, if the engine speed has been set to 1,000 rpm by the hand throttle the present invention will cause the engine speed to increase to 1,200 rpm during movement of the stabilisers and when movement of the stabilisers ceases will simultaneously allow the engine speed to fall to 1,000 rpm. If there is a period of activity (for example 1 minute) after the stabilisers have stopped moving, then auto idle function may result in the engine speed then falling to an idle speed of 800 rpm. Thus, the present invention may work in conjunction with an auto idle system. However, in further embodiments, whilst the present invention may be used on a machine fitted with auto idle, the present invention can operate independently of the auto idle. Thus, in the example above, where the present invention operates independently of the auto idle system, moving the stabilisers will increase the engine speed to 1,200 rpm and once movement of the stabilisers cease, the engine speed will fall to 800 rpm (rather than to 1,000 rpm in the above example).

Figure 2:
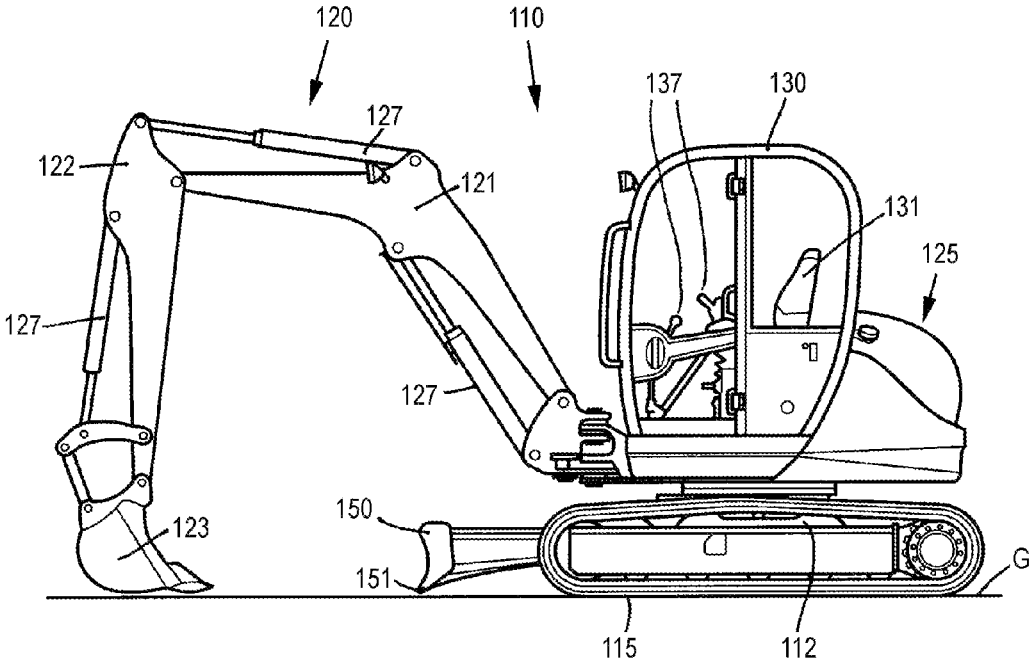
FIG. 2 shows a mini excavator which can be operated according to the present invention.

With reference to FIG. 2 there is shown a material handling vehicle 110 in the form of a mini excavator. A mini excavator includes a chassis 112 and tracks 115. A loading arm 120 includes a boom 121, a dipper arm 122 and a bucket 123. An engine 125 operates a hydraulic pump which can provide hydraulic rams 127 with pressurised hydraulic fluid so as to be able to manipulate the loading arm 120. The mini excavator includes an operator cab 130 having a seat 131. Operator controls 137 allow steering of the vehicle when being manoeuvred and control of the loader arm 120. The operator control 137 include a hand throttle which is operable to set the engine speed at a desired engine speed.

The vehicle includes a front mounted blade 150 having a lower edge 151. A hydraulic ram (not shown) can pivot the blade 150 about a generally horizontal axis such that the lower edge 151 can be engaged with and disengaged from the ground G. As will be appreciated, that part of the blade 150 that engages the ground (i.e. the lower edge 151) is constrained to move through a predetermined path, in this case an arc having its centre at the above mentioned generally horizontal axis. The blade 150 can perform two functions. Firstly, it can be used in the form of a bulldozer blade to move material around by driving the excavator along the ground thereby pushing material in front of the blade 150. The blade 150 can also be used to stabilise the machine when it is stationary and the loading arm 120 is being manipulated to move material. In order to act as a stabiliser, the hydraulic ram is actuated via a control device so that the lower edge 151 engages the ground G, thereby stabilising the machine when it is stationary. As shown in FIG. 2, the lower edge 151 is disengaged from the ground and the blade is in a retracted position. Operation of the vehicle 110 is similar to operation of the back hoe loader 10 in as much as with the engine running at an idle speed should the operator decide to move the blade, either to a deployed position from a retracted position, or from a retracted position to a deployed position the control device causes movement of the blade and simultaneously increases the engine speed. Once the blade has been positioned as desired the operator releases (or unactuates) the control device thereby causing the blade to stop moving and simultaneously causing the engine speed to fall, typically to an idle engine speed or to a speed defined by a hand throttle setting. If the engine speed falls to a speed defined by a hand throttle setting and the machine is fitted with an auto idle which is enabled, then following a period of inactivity the auto idle function may operate to reduce the engine speed to below the hand throttle setting, either in the single step to an engine idle speed or progressively to an engine idle speed.

As shown in FIG. 2 the blade 150 is pivotally mounted relative to the chassis. In further embodiments a blade may be mounted via a four bar linkage to the chassis to provide a parallel motion for the blade as it is lifted and lowered. Thus, the four bar linkage may consist of a first link which is pivotally mounted directly to the chassis and which is pivotally mounted to an upper portion of the blade and also include a second link which is pivotally mounted directly to the chassis and is pivotally mounted to a lower portion of the blade. The first link may be above the second link. As will be appreciated, the lower edge of the blade will be constrained to move through a predetermined path, in this case the path is predetermined by how the four bar linkage moves.

For the avoidance of doubt, in the examples above the engine idle speed was 800 rpm. The invention is equally applicable to engines which run at an idle speed other than 800 rpm. In the examples above upon movement of the stabilisers the engine has been increased to 1200 rpm. The invention is not limited to increasing the engine speed to 1200 rpm. The invention is equally applicable to increasing the engine speed to speeds other than 1200 rpm. In the example above the working speed of 2000 rpm were set by the operator. The present invention is applicable to machines where a working speed can be set to any speed within the working range of the engine.

As mentioned above, the stabilisers 40 and 42 pivot about a generally horizontal axis as they move between a deployed and a retracted position. The invention is applicable to any type of stabiliser. In particular the invention is applicable to stabilisers which move (or translate) generally vertically between a deployed and a retracted position. In particular, a machine (such as a back hoe loader) may include a rear right stabiliser which moves (or translates) generally vertically and a rear left stabiliser which moves (or translates) generally vertically. As will be appreciated, the foot of such a translating stabiliser is constrained to move through a predetermined path, in this case the path being a straight line.

As shown in FIG. 1 the stabilisers are on the back of the machine and as shown in FIG. 2 the stabilising blade 150 is on the front of the machine. In further embodiments other types of stabiliser may be mounted on the back of the machine and other types of the stabiliser may be mounted on the front of the machine. In particular, stabilisers which pivot about a generally horizontal axis, similar to stabilisers 40 and 42 may be mounted on the front of the machine, in particular a telehandling machine. Similarly, stabilisers which move (or translate) generally vertically may be mounted on the front of a machine such as a telehandler, in particular such a stabiliser may be mounted on the front right of the machine and such a stabiliser may be mounted on the front left of the machine.

As shown in FIG. 1, the wheels 14 and 16 include elastomeric tyres, in this case pneumatic tyres. Stabilisers are particularly applicable to machines with elastomeric (such as pneumatic) tyres since the elastomeric tyre tends to deflect, thereby rocking or moving the chassis and the cab as material is manoeuvred by a back hoe or the like unless stabilisers are deployed.

As shown in FIG. 2 the tracks 15 are elastomeric tracks, in this case rubber like tracks (as opposed to non-elastomeric tracks such as steel or other metal tracks).

The wheels 14 and 16 of back hoe loader 10 and the tracks 115 of the mini excavator constitute a ground engaging motive device since they engage the ground when it is necessary to move the machine over the ground. The present invention is particularly applicable to machines having elastomeric ground engaging motive devices, in particular elastomeric tyres, for example pneumatic tyres.

As mentioned above, actuating the control devices to move stabilisers causes the engine speed to increase and unactuating the control devices causes the engine speed to fall. In further embodiments the increase in engine speed may be proportional to the amount of movement of the control devices. Thus, a relatively small movement of the control devices may only increase the engine speed a relatively small amount whereas the relatively large movement of the control devices may cause a consequential greater increase in engine speed. Under both scenarios when the control devices is unactuated the engine speed will fall. This is useful when small changes to the position of the stabilisers are required. In a further embodiment a small movement of the control devices may not increase the engine speed whereas a relatively large movement of the control devices may increase the engine speed. Such an arrangement is useful when making final adjustments to the position of the stabilisers.

The invention claimed is:

1. A method of operating a material handling machine, the machine including an engine, one or more stabilisers, and a control means selectively operable by an operator to move the one or more stabilisers, the method including the steps of:— a) starting with the one or more stabilisers in a first position and the engine running at a first engine speed, b) actuating the control means to move at least one of the stabilisers towards a second position, actuation of the control means causing the engine speed to increase, c) unactuating the control means so as to simultaneously stop movement of said at least one of the stabilisers and allow the engine speed to reduce towards the first engine speed.

2. A method as defined in claim 1 wherein the first engine speed is an engine idle speed.

3. A method as defined in claim 2 wherein the machine includes one or more operator actuated throttles, each of the one or more operator actuated throttles being set to one of an engine idle speed or a disabled condition.

4. A method as defined in claim 1 wherein the first engine speed is above an engine idle speed and is set by an operator actuator throttle device.

5. A method as defined in claim 4 wherein the machine includes an auto idle function operable to reduce the engine speed below an engine speed defined by the operator actuated throttle device after a period of inactivity.

6. A method as defined in claim 5 including the step of:— d) allowing the auto idle function to reduce the engine speed to below the first engine speed.

7. A method as defined in claim 3 wherein the one or more operator actuator device is selected from a hand throttle and a foot throttle.

8. A method as defined in claim 1 wherein each of the one or more stabilisers is constrained to move through a predetermined path when moving between the first position and the second position.

9. A method as defined in claim 1 wherein the one or more stabilisers are defined by a first stabiliser mounted on a right hand side of the machine and a second stabiliser mounted on a left hand side of the machine.

10. A method as defined in claim 9 wherein the first and second stabilisers are mounted on the rear of the machine.

11. A method as defined in claim 9 wherein the first and second stabilisers are mounted on the front of the machine.

12. A method as defined in claim 9 wherein the first and second stabilisers are pivotally mounted about a generally horizontal axis to move between a retracted and deployed position.

13. A method as defined in claim 9 wherein the first and second stabilisers are translatable generally vertically to move between a retracted and a deployed position.

14. A method as defined in claim 1 wherein the one or more stabilisers is defined by a transversely orientated blade.

15. A method as defined in claim 14 wherein the blade is pivotally mounted directly to a chassis of the machine so as to be constrained to move about an arc.

16. A method as defined in claim 14 when a first link is pivotally mounted directly to a chassis of the machine and is pivotally mounted to the blade and a second link is pivotally mounted directly to the chassis of the machine and is pivotally mounted to the blade so as to form a four bar linkage.

17. A method as defined in claim 1 wherein the machine further includes one or more elastomeric ground engaging motive devices.

18. A method as defined in claim 1 wherein during step b) the engine speed increases to a predetermined speed.

19. A method as defined in claim 1 wherein during step b) engine speed increases proportionally to an amount of actuation of the control means.

20. A method as defined in claim 1 wherein during step b) only actuation of the control means beyond a predetermined position causes the engine speed to increase.

21. A method as defined in claim 1 wherein actuation of the control means automatically causes the engine speed to increase.

22. A method as defined in claim 3 wherein the second position of the control means comprises a deployed position, and wherein the at least one of the stabilisers is moved towards the second position while the one or more operator actuated throttles are idle.

* * * * *